US006137238A

United States Patent [19]

Alvarez et al.

[11] Patent Number: 6,137,238

[45] Date of Patent: Oct. 24, 2000

[54] HIGH-EFFICIENCY SELF-REGULATED ELECTRONIC BALLAST WITH A SINGLE CHARACTERISTIC CURVE FOR OPERATING HIGH-PRESSURE SODIUM VAPOR LAMPS

[76] Inventors: Eduardo Salman Alvarez; Arturo Hernandez Lopez; Nefi Sifuentes Rodriguez, all of Avenida 5 de Mayo #905 Nte., Col. San Francisco, Cd. Victoria, Tamaulipas 87050, Mexico

[21] Appl. No.: 09/155,214

[22] PCT Filed: Mar. 17, 1997

[86] PCT No.: PCT/MX97/00006

§ 371 Date: Sep. 24, 1998

§ 102(e) Date: Sep. 24, 1998

[87] PCT Pub. No.: WO97/34464

PCT Pub. Date: Sep. 25, 1997

[30] Foreign Application Priority Data

Mar. 18, 1996 [MX] Mexico ..... 961018
Feb. 24, 1997 [MX] Mexico ..... 971373

[51] Int. Cl.[7] ..... G05F 1/00

[52] U.S. Cl. ..... 315/291; 315/199; 315/209 R

[58] Field of Search ..... 315/199, 246, 315/151, 307, 209 R, 149, 291

[56] References Cited

U.S. PATENT DOCUMENTS

| | | | |
|---|---|---|---|
| 4,580,080 | 4/1986 | Smith | 315/199 |
| 4,682,084 | 7/1987 | Kuhnel et al. | 315/307 |
| 4,749,914 | 6/1988 | Feher et al. | 315/246 |
| 4,751,398 | 6/1988 | Ertz, III | 307/66 |
| 4,999,547 | 3/1991 | Ottenstein | 315/307 |
| 5,045,758 | 9/1991 | Hildebrand | 315/151 |
| 5,117,161 | 5/1992 | Avrahami | 315/226 |
| 5,491,386 | 2/1996 | Hiroyasu et al. | 315/209 |
| 5,789,868 | 8/1998 | Sears | 315/149 |
| 5,949,199 | 7/1999 | Qian et al. | 315/307 |

FOREIGN PATENT DOCUMENTS

| | | |
|---|---|---|
| 2095930 | 10/1982 | United Kingdom . |
| WO 9216085 | 9/1992 | WIPO . |
| WO 9403034 | 3/1994 | WIPO . |

*Primary Examiner*—Don Wong
*Assistant Examiner*—Chuc Tran
*Attorney, Agent, or Firm*—Frishauf, Holtz, Goodman, Langer & Chick, P.C.

[57] ABSTRACT

A high-efficiency self-regulated electronic ballast with a single characteristic curve for operating high-pressure sodium vapor lamps by means of an AC-to-DC converter circuit, a power factor correcting regulator circuit for reducing harmonic distortion, a high-frequency DC-to-AC converter circuit, a reducing autotransformer circuit with a current limiting inductor and an igniter, and a light-controlled switching circuit. The ballast is characterized in that it supplies a controlled high-frequency alternating voltage to the assembly of the limiting inductor and the lamp, whereby the ballast has a single characteristic curve, and in that the average power consumption of the lamp is determined on the basis of the single characteristic curve of the ballast within the standard regulation trapezoid defining the average consumption of the ballast/lamp assembly. Said ballast has uniform regulation characteristics, high electrical efficiency, a unitary power factor, low harmonic distortion, a high ballast efficiency factor, and a low stroboscopic effect.

7 Claims, 4 Drawing Sheets

Figures 1A, 1B, 1C, 1D:
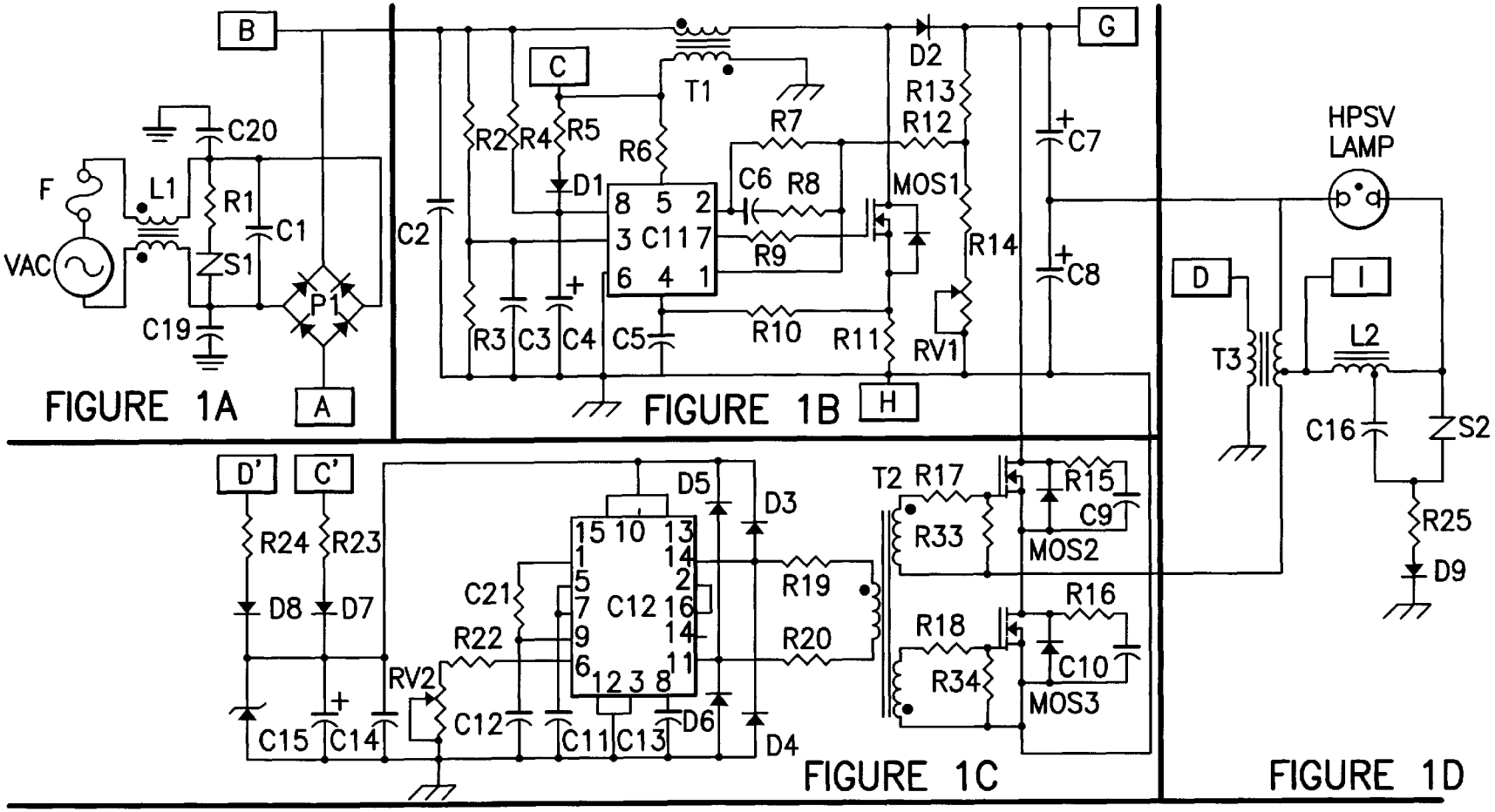

HPSV LAMP
I
L2
C16
S2
R25
D9
T3
D
G
C7
C8
D2
R13
R12
MOS1
R14
RV1
R7
C6
R8
R9
R10
R11
H
T1
R6
C5
C
R5
D1
C4
R4
C3
R2
R3
C2
B
C20
R1
C1
S1
C19
L1
F
VAC
P1
A

R15
C9
MOS2
R16
C10
MOS3
T2
R17
R33
R18
R34

D3
R19
R20
D4
D5
C12
D6
C13
C11
C21
R22
C12
RV2
C14
C15
C'
R23
D7
D'
R24
D8

NOTE:

PHYSICAL GROUND

COMMON POINT

| | | | | | | | | | | | | | | |
|---|---|---|---|---|---|---|---|---|---|---|---|---|---|---|
| LAMP | V | # | 38.0 | 40.0 | 42.5 | 45.0 | 47.5 | 50.0 | 52.5 | 55.0 | 57.5 | 60.0 | 62.5 | 65.0 | 67.5 |
| LAMP | P | # | 80.5 | 85 | 88 | 90.5 | 93 | 95 | 97.5 | 99.5 | 101 | 101.5 | 102 | 101.5 | 101 |

| | | | | | | | | | | | | | | | |
|---|---|---|---|---|---|---|---|---|---|---|---|---|---|---|---|
| LAMP | V | # | 70.0 | 72.5 | 75 | 77.5 | 80.0 | 82.5 | 87.5 | 90.0 | 92.5 | 95.0 | 97.5 | 100.0 | 102.5 |
| LAMP | P | # | 100 | 98 | 95.5 | 92 | 88 | 85 | — | — | — | — | — | — | — |

HIGH-EFFICIENCY SELF-REGULATED ELECTRONIC BALLAST WITH A SINGLE CHARACTERISTIC CURVE FOR OPERATING HIGH-PRESSURE SODIUM VAPOR LAMPS

For a long time, ferromagnetic ballasts were the only means of operating high-pressure sodium-vapor lamps. These ballasts involved losses ranging from 16% in the best cases to 50% or more, and this led to a considerable waste of electrical energy, which was manifested as heat generated in the ballasts and radiated both to the environment and to the other components that were part of the unit, such as the lamp ignitor starting circuit and the power-factor correction capacitor. In addition to having considerable weight due to their basic iron and copper construction, ferromagnetic ballasts produce a harmonic distortion upwards of 20%. In order to obtain ignition, these ballasts apply high-voltage pulses to the lamp ranging from 2500 to 5000 volts, at a frequency of 120 to 240 pulses per second; these pulses can damage the lamp when an attempt is made to re-light it while it is hot, since it cannot be re-lighted until it is cool.

Although they are called self-regulated, ferromagnetic ballasts which attempt to supply regulated energy to the lamp with respect to line voltage changes, they cannot do this very well, since they increase or decrease the power consumption of the ballast-lamp unit, as well as the amount of light produced, in accordance with the respective increase or decrease in the input voltage. Due to the aforementioned problem, a Regulating Trapezoid was created, which defines the limits that restrict the operation of the lamp and the ballast in this type of system. These limits have been established by organizations such as the American National Standards Institute (ANSI), wherein the power of the lamp is plotted as a function of its voltage. This graph is known as the characteristic curve of the ballast and it is established in accordance with the input voltage to the ballast-lamp unit; therefore, if the input voltage of the unit varies, a new ballast characteristic curve must be plotted, and for this reason, in ballasts known so far, there is an endless number of curves as the input voltage varies, and thus it is impossible to determine an average power consumption for the ballast-lamp unit.

Ferromagnetic ballasts supply electrical energy to the lamp at a frequency of 60 Hz, which is equal to that of the input line, producing an important stroboscopic effect at this frequency. These ballasts do not have an integrated photocell, and therefore, this device must be added to the unit as an accessory, in order to obtain automatic control of the switching-on and/or switching-off function.

There are also electronic ballasts for operating high-pressure sodium-vapor lamps as described in Patent Application 9601018. These ballasts overcome some important disadvantages of the ferromagnetic ballast technology, considering their compact size, light weight, and even more importantly, their extremely high electrical efficiency.

However, they produce a large amount of harmonic distortion, they are not regulated, and have no overvoltage protection for the case in which they are connected to a voltage that is higher than the maximum nominal voltage or if there is a line-fault. In addition, they have an infinite number of ballast characteristic curves depending on the variations in the input voltage.

In order to eliminate these and other disadvantages, we developed the present high-performance self-regulated electronic ballast with a single characteristic curve to operate high-pressure sodium-vapor lamps, which we intend to protect by means of this patent application, since it is a sufficiently novel device. This ballast is provided unique regulating characteristics, high electrical efficiency, a unitary power factor, low harmonic distortion, a single characteristic curve, energy savings, a high ballast efficiency factor, and a significant decrease in the stroboscopic effect; it also provides protection, and improves lamp usage.

The operating method of this efficient electronic ballast is clearly demonstrated in the following description, with the help of the accompanying figures, and it can be applied to all high-pressure sodium-vapor lamp powers and to different voltages that may be used to supply the ballast, simply by changing the values and capacities of some of its components.

FIG. 1 is a diagram of the electronic ballast, which illustrates the functional circuits that it comprises, which for descriptive purposes, are shown separately and are also denominated as figures.

FIG. 1A. Alternating-Current (AC) to Direct-Current (DC) Convertor and Protective Devices. This circuit consists of F, which is a quick-break fuse, line filter L1, resistor R1, sidac S1, capacitors C1, C19 and C20 and diodes bridge P1. This circuit carries out the function of a full wave rectifier of the alternating voltage of the input line by the action of bridge P1. In this circuit, protection against overcurrent is provided by the action of F, and protection against voltage transients is provided by L1 and C1. If the voltage is increased by more than 20% of the nominal value, sidac S1 enters into conduction causing a limited overcurrent due to R1, but enough to cause F to be also actuated, thus protecting the ballast. This circuit filters the high-frequency interferences, generated by the operation of the subsequent circuits, by means of L1 and C1, thus preventing them from affecting the input line, and decreasing harmonic distortion. C19 and C20 carry out a function similar to that of C1, permitting drainage of part of the distortions and giving a reference point from ballast to ground.

FIG. 1B. Regulator Circuit That Corrects the Power Factor and Decreases Harmonic Distortion. This circuit comprises integrated circuit C11, resistors R2 to R14, potentiometer RV1, capacitors C2 to C8, transformer T1, diodes D1, D2 and MOSFET power transistor MOS1. This circuit provides regulated voltage at point G, with reference to point H, due to the operation of C11 and its associated components, and at the same time it permits the alternating-current drain in the ballast intake to have a sinusoidal shape with a harmonic content of less than 10% and a practically unitary power factor (0.999). The voltage level at point G can be adjusted by potentiometer RV1 together with resistors R13 and R14. This regulator circuit provides the ballast with great versatility, since it can work at different line input voltages, and provide adequate regulated voltage such that in conjunction with autotransformer T3, the ballast can operate lamps of different types and powers. This circuit provides voltage regulation of approximately 99% at point G, which causes that the ballast has a single characteristic curve, even when the alternating current input voltage changes by ±20% of the nominal value. By adapting the values of the external components of C11, including the MOS1 and the T1 turns ratio, this circuit can operate at different ballast voltages, which may be 127 VAC, 220 VAC, 440 VAC, and may also include different direct-current voltages. T1 is constructed with a ferrite core with an air gap and a coil assembly consisting of a multifilament conductor, preferably with 8 filaments of 32-gauge magneto wire, which reduces losses and the generation of heat in this transformer, thus increasing the efficiency of the ballast;

although it is possible to obtain the same effect with other combinations of the number of wires and the wire caliber, the previous values are given solely for the purpose of indicating a conventional preference and not of unduly limiting the design of the multifilament conductor employed in the construction of T1.

FIG. 1C. Direct-Current (DC) to High-Frequency Alternating-Current (AC) Convertor. This circuit comprises MOSFET power transistors MOS2 and MOS3 which are excited with a square wave generated by oscillator integrated circuit C12 through the exciter/insulator transformer T2 and resistors R17, R18, R19, R20, R33 and R34. The oscillating frequency of C12 can be adjusted by RV2, which acts in conjunction with components C11 and R22; it lies between 10 kHz and 20 kHz, because within this operating range, the lamp emits a greater amount of luminous flux than the flux that is produced with 60 Hz, when the same power is supplied. Resistor R21, capacitors C12 and C13, diodes D3 to D6 help to form the square wave generated, which makes it possible to drive MOS2 and MOS3 alternately, providing a regulated alternating voltage on terminals 1 and 3 of autotransformer T3 (FIG. 1D), with maximum positive and negative values, with reference to terminal 1 of T3, corresponding to points G and H, respectively. The MOS2 and MOS3 switching operation is free of electromagnetic emissions, which might cause interference, due to the action of networks R15-C9 and R16-C10. The power source for this circuit is formed by resistors R23 and R24, capacitors C14 and C15, diodes D7 and D8, and zener diode Z1. Integrated circuit C12 receives power for its operation, during the beginning of the ballast operation, from the T1 secondary (point C) through components R23 and D7, and when the ballast is in stable continuous operation, it receives power from the auxiliary secondary of T3 (point D) through components R24 and D8, thus avoiding the necessity for forming this source from the line or from point B, and the result is energy savings and a reduction in the number of components.

FIG. 1D. Reducing Autotransformer With Current Limiting Inductor and Ignitor. This circuit comprises autotransformer T3, limiter autotransformer L2, resistor R25, capacitor C16, diode D9 and sidac S2. Autotransformer T3 carries out the function of reducing the regulated alternating voltage which is present between its terminals 1 and 3 to the minimum open circuit voltage for the ballast (point I), as recommended by the lamp manufacturers for each one of the existing powers and types, at the same time that it reduces the current and the peaks of the same, which circulate through transistors MOS2 and MOS3, thus reducing losses or the generation of heat in the MOSFETS: T3 has an auxiliary secondary in terminals 4 and 5 to supply C11 (point D). Autotransformer T3 permits great versatility since, when the transformation ratio is varied, it is possible, in conjunction with the regulator circuit in FIG. 1B, to operate lamps of different powers and with different ballast input voltages. This autotransformer is constructed with a ferrite core and a multifilament conductor coil assembly, preferably with 16 filaments of 32-gauge magneto wire, which makes it possible to decrease losses and the generation of heat in this autotransformer, thus increasing the ballast's efficiency; although it is possible to obtain the same effect with other combinations of the number of wire filaments and gauge, the aforementioned values are given solely for the purpose of indicating a conventional preference and not of unduly limiting the design of a multifilament conductor employed in the construction of T3. The function of limiting autotransformer L2 is to present an impedance, such that, at the operating frequency of the applied alternating voltage, it is capable of limiting the starting current, and later of continuous operation within the range of values recommended by the lamp manufacturers, thus ensuring the appropriate operation of the lamps during their service life; L2 also functions as an autotransformer and in conjunction with components C16, S2, R25 and D9, it generates the high voltage pulses required to start the lamp. The inclusion of D9 in this part of the circuit permits C16 to be charged slowly and independently of the operating frequency of the alternating voltage applied to the lamp. When the value of C16 that is selected is adequate to permit the generation of a pulse of the amplitude and duration required for starting the lamp, the frequency of the pulses will then be determined by the previously selected value of C16 and resistor R25; however, since only the first one of the pulses applied to the lamp is the one that executes ignition or starting, a lower frequency than that indicated in the standard (120 to 240 pulses per second) can be used. In our case, an operating frequency of 2 to 3 pulses per second was selected, and this value is indicative of our preference and does not limit the operation to a range of less than 120 pulses per second. The ignition operation takes place when an alternating voltage on the T3 secondary (terminals 1 and 2) is presented, which voltage reaches the level of the minimum open circuit voltage of the ballast that is applied to the limiter inductor L2-lamp unit (point I), directly on L2; then C16 is charged through R25 and D9 at a voltage value such that it leads to sidac S2, generating the discharge of C16 on some L2 turns, which keep the appropriate ratio with the rest of its winding to produce the high voltage pulses in its terminals, which now reach the lamp and turn it on. Once it is turned on, the open circuit voltage of the ballast drops to the lamp's continuous operating levels, and thus C16 cannot be charged at the S2 firing level, preventing the ignitor circuit to function. Limiter inductor L2 is constructed with a ferrite core with an air gap and a multifilament conductor coil assembly preferably with 16 filaments of 32-gauge magneto wire which makes it possible to reduce losses and the generation of heat in this limiter inductor, thus increasing the efficiency of the ballast; although it is possible to obtain the same effect with other combinations of the number of filaments and the gauge of the wire, the aforementioned values are given solely for the purpose of indicating a conventional preference and not of unduly limiting the design of a multifilament conductor employed in the construction of L2. The number of turns and the air gap of limiter inductor L2 can be varied to adjust their impedance to the suitable value for operating each power and type of lamp.

Figure 1E:
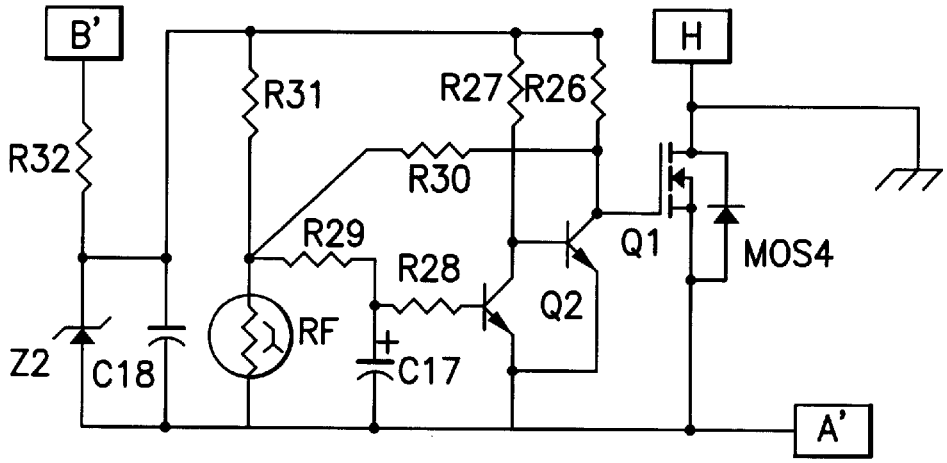

FIG. 1E. Photocontrolled Switching Circuit (Automatic Photocontrol or Integrated Photocell). This circuit comprises resistors R26 to R32, capacitors C17 and C18, zener Z2, transistors Q1 and Q2, cadmium-selenide photoresistor RF and mosfet power transistor MOS4, which acts as an electronic switch in accordance with the light intensity that strikes the RF. This characteristic makes it possible for the RF to detect the reduction in natural light at dusk, and when it is reduced by 40 luxes, by means of associated components, it directs MOS4 toward conduction, which switches on the ballast. The latter remains on until daybreak when the natural light intensity reaches the preestablished level of 125 luxes so that the RF directs the MOS4 toward non-conduction and the ballast is switched off. This photocontrolled switching circuit operates between point A and common point H in the DC part of diodes bridge P1. The selection of MOS4 due to its extremely low internal resistance and because it operates in DC, as well as the selection of the other components that form this circuit, makes it possible to eliminate losses or the generation of heat, thus increasing the ballast's efficiency.

The circuits described above work together in the following manner:

When the ballast is energized through the alternating current to direct-current converter circuit in FIG. 1A, the rectified line voltage appears in a full wave on point B. From this point, and with reference to A, the automatic photocontrol circuit in FIG. 1E is supplied, which, depending on the aforementioned preestablished levels of natural light, maintains MOS4 in conducting or non-conducting mode, transferring or not, as the case may be, the reference potential of A to the common point H of the supply of all other sections of the ballast. When MOS4 is conducting, the current circulates from point B to point G through T1 and D2, thus initiating the operation of the regulator circuit in FIG. 1B, when C11 receives power through R4; C11 increases the voltage at point G, assisted by T1 and MOS1, up to the preestablished level which can be adjusted by means of potentiometer RV1, and said level is maintained even when there are changes in the input line voltage or changes in the lamp's requirements due to its operation. This regulation is very close to 99% and allows the ballast to have practically a single characteristic operating curve for each power and each type of lamp for which the ballast is manufactured, even when the input voltage for the same changes by ±20%. In addition to serving as positive feedback for the control itself, the T1 secondary is used to provide a constant input to C11 (point C). It also provides the input supply so that C12 can begin to operate through R23 and D7.

When oscillator circuit C12 is functioning, direct current to high-frequency alternating-current converter circuit in FIG. 1C begins to operate, and therefore, transistors MOS2 and MOS3 are driven through T2, and a square-wave regulated alternating voltage with a positive maximum value corresponding to G and a maximum negative value corresponding to H appears in terminal 3 of T3, all with respect to terminal 1 of T3. This regulated alternating voltage is transformed directly by T3, which at its reduced output from point I (terminals 4 and 5), provides the ballast's minimum open circuit voltage to the limiter inductor L2-lamp unit causing the ignitor circuit to function, which switches on the lamp when high voltage pulses are produced. When the lamp is turned on, the current is limited by L2, thus reducing the voltage on the same, while the ignitor stops functioning when it fails to reach the sidac S2 triggering voltage.

Tables 1, 2, and 3 show the results of Test Report No. K3042-013/96, which includes the results of tests conducted at the Salvador Cisneros Chavez Equipment and Materials Testing Laboratory (LAPEM), which is a subsidiary of CFE with headquarters in the city of Irapuato, Gto Mexico. These tests evaluated three samples of high-efficiency self-regulated electronic ballasts with a single characteristic curve for operating high-pressure sodium-vapor lamps rated at 70, 100 and 150 watts.

The tests conducted included consumption, regulation, harmonic distortion and power factor, as well as compared light emission (luxes) per watt consumed for each sample evaluated against conventional ballasts.

In Table 1, we can observe comparative tables containing the data obtained for the high-efficiency self-regulated electronic ballast with a single characteristic curve used to operate 70-watt sodium-vapor lamps in comparison with its ferromagnetic equivalent of the self-regulated type. It should be noted that for the electronic ballast, illumination is the same throughout the input voltage variation range, since the consumed power of the ballast-lamp unit remains practically constant from −10% (110 V) of nominal voltage (Vn=128.2 V) to +10% (140 V) of Vn; its lux/watt ratio at nominal voltage is 0.904, while the same ratio for the ferromagnetic ballast is 0.58.

In Table 2, we can observe the comparative tables containing the data obtained for the high-efficiency self-regulated electronic ballast with a single characteristic curve for operating 100-watt sodium-vapor lamps in comparison with its ferromagnetic equivalent of the self-regulating type. It should be noted that, for the electronic ballast, illumination remains constant throughout the input voltage range, since the consumed power of the ballast-lamp unit also remains practically constant from −10% (110.4 V) of nominal voltage (Vn=127 V) to +10% (140.9 V) of Vn; its lux/watt ratio at nominal voltage is 0.64, while the same ratio for the ferromagnetic ballast is 0.56.

In Table 3, we can observe the comparative tables containing the data obtained for the high-efficiency self-regulated electronic ballast with a single characteristic curve for operating 150-watt sodium-vapor lamps in comparison with its ferromagnetic equivalent of the self-regulated type. In this figure also, it should be noted that for the electronic ballast, illumination remains constant throughout the input voltage range, since the drainage power of the ballast-lamp unit remains practically constant from −10% (110.0 V) of the nominal voltage (Vn=127.1 V) to +10% (140.0 V) of Vn; its lux/watt ratio at nominal voltage is 0.665, while the same ratio for the ferromagnetic ballast is 0.649.

TABLE 1

Values obtained with 70-watt electronic and ferromagnetic ballast

| Voltage range | Voltage (volts) | Current (amps) | COS [Power factor] | Illumination (luxes) | Distortion (%) | Power VI COS | Power W/H. |
|---|---|---|---|---|---|---|---|
| Nominal voltage | 128.2 | 0.570 | 0.999 | 66 | 8.61 | 73.07 | 73.00 |
| +10% Vn | 140.0 | 0.523 | 0.999 | 66 | 9.90 | 73.14 | 72.86 |
| −10% Vn | 110.0 | 0.663 | 0.999 | 66 | 7.20 | 72.85 | 72.72 |

Comments

Note that illumination is the same throughout the voltage variation range; range other words, regulation is good, and the consumption illumination ratio is maintained.

The lux/watt ratio at nominal voltage (Vn) is 0.904.

70 W Self-Regulated Ferromagnetic Ballast

| Vn (volts) | Current (amps) | COS [power factor] | Illumination (luxes) | Distortion (%) | Power VI COS; | Power W/H. |
|---|---|---|---|---|---|---|
| 127.5 | 0.768 | 0.981 | 54 | 26.7 | 96.11 | 93.24 |

Note

It can be observed that at nominal voltage, the power consumption in the ferromagnetic ballast is 27.7% more than in the electronic ballast, and the lux/watt ratio is 0.58.

TABLE 2

Values obtained with 100-watt electronic and ferromagnetic ballast

| Voltage range | Voltage (volts) | Current (amps) | COS [Power factor] | Illumination (luxes) | Distortion (%) | Power VI COS | Power W/H. |
|---|---|---|---|---|---|---|---|
| Nominal voltage | 127.0 | 0.820 | 0.999 | 67 | 8.00 | 104.03 | 103.53 |
| +10% Vn | 140.9 | 0.737 | 0.999 | 67 | 9.05 | 103.73 | 103.10 |
| −10% Vn | 110.4 | 0.944 | 0.999 | 67 | 7.07 | 104.11 | 103.24 |

Note

The lux/watt ratio at nominal voltage is 0.64.

illumination is maintained practically throughout the voltage range.

100-W Self-regulated Ferromagnetic ballast

| Vn (volts) | Current (amps) | COS [power factor] | Illumination (luxes) | Distortion (%) | Power VI COS; | Power W/H. |
|---|---|---|---|---|---|---|
| 127.5 | 1.05 | 0.988 | 72.3 | 29.9 | 132.26 | 127.12 |

Note

It can be observed that at the nominal voltage the power consumption in the ferromagnetic ballast is 22.7% more than in the electronic ballast and the lux/watt ratio is 0.56.

TABLE 3

Values obtained with the 150-watt electronic and ferromagnetic ballast

| Voltage range | Voltage (volts) | Current (amps) | COS [Power factor] | Illumination (luxes) | Distortion (%) | Power VI COS | Power W/H. |
|---|---|---|---|---|---|---|---|
| Nominal voltage | 127.1 | 1.193 | 0.999 | 100.8 | 6.0 | 151.47 | 152.35 |
| +10% Vn | 140.0 | 1.078 | 0.999 | 100.8 | 6.83 | 150.76 | 151.2 |
| −10% Vn | 110.0 | 1.387 | 0.999 | 100.8 | 4.80 | 162.41 | 151.77 |

Comments

The lux/watt ratio at nominal voltage is 0.665.

Illumination is maintained throughout the voltage variation range.

150 W Self-Regulated Ferromagnetic Ballast

| Vn (volts) | Current (amps) | COS [power factor] | Illumination (luxes) | Distortion (%) | Power VI COS; | Power W/H. |
|---|---|---|---|---|---|---|
| 127.5 | 1.418 | 0.998 | 114 | 23.70 | 180.43 | 175.39 |

Note

At nominal voltage, the power consumption in the ferromagnetic ballast is 15.1% more in the electronic ballast and the lux/watt ratio is 0.649.

LAPEM offers the following conclusions at the end of its report:

"In the electronic ballast models evaluated, which are 70, 100 and 150 watts, a reduction in the power consumption of 27.7%, 22.7% and 15.1%, respectively, was found under the same conditions, in comparison with the ferromagnetic ballast. It also retained practically the same illumination in spite of variations in input voltage; however, in the ferromagnetic ballasts, the illumination varies in a different manner as the input voltage changes."

Harmonic distortion remains below 10% and the power factor is unitary for all of the three ballasts evaluated.

Figure 2:
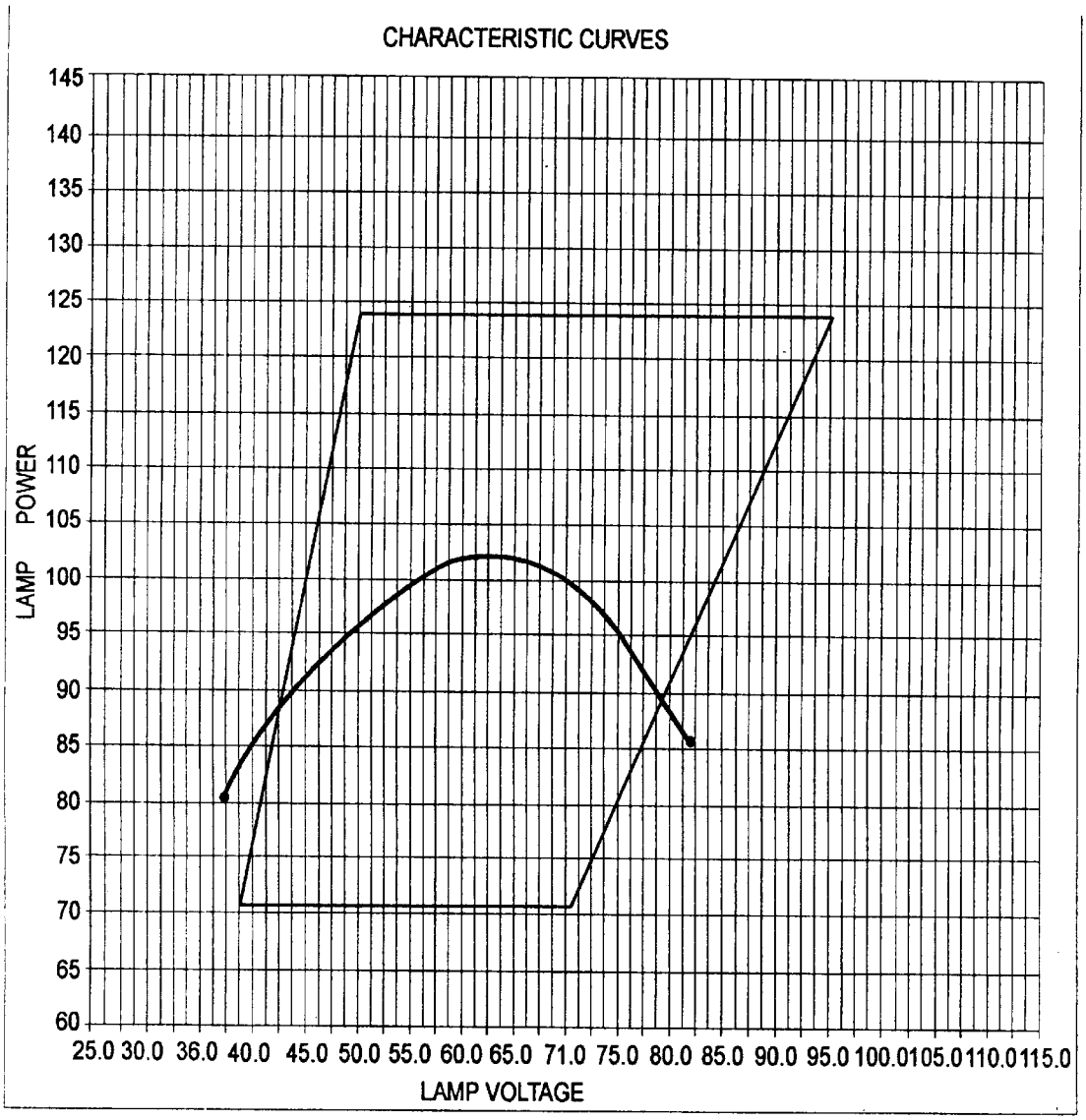

One of the most important factors of this electronic ballast is its characteristic of having a single ballast characteristic curve regardless of the input voltage to the ballast-lamp unit within the range of ±20% of the nominal voltage. FIG. 2 shows the curve for the high-efficiency electronic ballast with a single characteristic curve for operating high-pressure sodium-vapor lamps with 100 watts of power.

Figure 3:
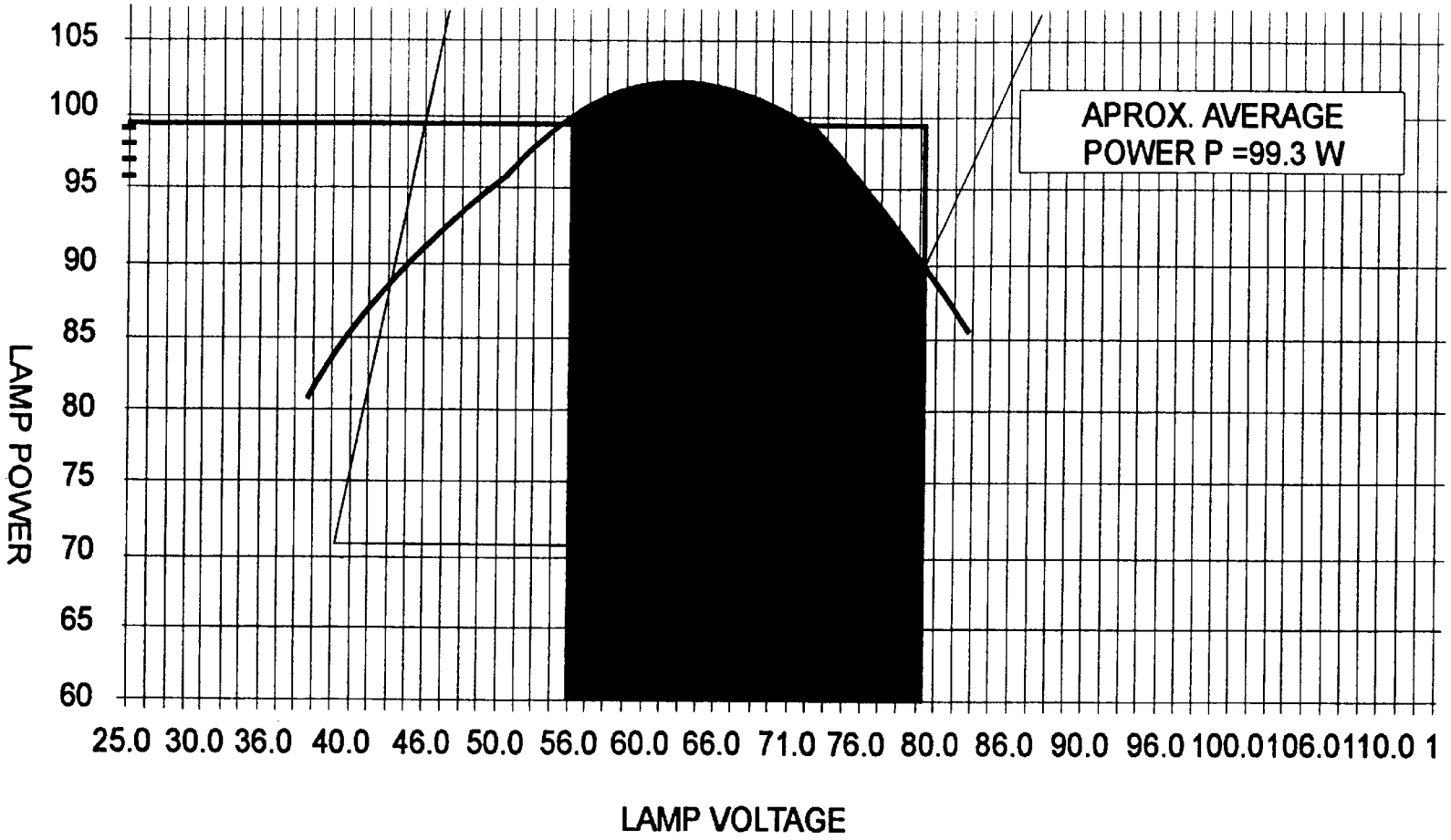

This single characteristic curve describes all of the power values that the lamp will use throughout its trajectory established across the standardized regulation trapezoid. As can be observed, the curve enters the trapezoid with a lamp power value of 88 watts, rises to its peak with a lamp power of 102 watts, and descends to leave the trapezoid with a lamp power value of 90 watts. However, it is expected that a 100-watt high-pressure sodium-vapor lamp, which is completely new, will be able to establish its characteristic lamp voltage of 55 watts after the first 100 hours of continuous operation; therefore, the segment of the curve which goes from the point of entry to the trapezoid to the characteristic point of the lamp at 99.5 watts and 55 volts, describes only the lamp's "burn-out" process. Thus, we can consider that the area under the segment of the curve that goes from the lamp's characteristic point to the point where it leaves the trapezoid (defined by the lamp's voltage axis) is directly proportional to the average power consumed by the lamp throughout its trajectory through the ballast's single characteristic curve, as can be seen in FIG. 3, where the shaded section under the curve indicates the area in question.

This area under the curve can be determined by different methods, both geometric and computerized numerical analysis, with the latter method being more accurate. The same analysis can be applied for the single characteristic curves of our electronic ballasts for operating 70 and 150 watt high-pressure sodium-vapor lamps.

In this way an electronic ballast with the following principal characteristics is obtained:

It has quick-break fuse protection against overcurrents, as well as active protection against transient voltages higher than the nominal voltage X1.2, or against faults in case it is connected to higher than the nominal voltage X1.2.

Almost unitary power factor (0.999).

Harmonic distortion of less than 10% and almost no electromagnetic interference.

It can be constructed so that it operates at the most common AC input voltage levels, which may be 127 V, 220 V, 254 V, 277 V, 440 V and 480 V, at 50 or 60 Hz, by changing the T3 autotransformer ratio as well as the values and capacitances of some other components.

It can be constructed so that it operates high-pressure sodium-vapor lamps of different types and powers.

It operates the lamp at a frequency range of 10 kHz to 20 kHz.

It maintains high-level regulation in both the electrical energy consumption of the ballast-lamp unit and the luminous flux emission, even with variations of ±20% in the input voltage.

It has a single ballast characteristic curve in the "Drop-Out" test with −10% and +10% of the nominal input voltage.

Electrical efficiency up to 94%, which provides considerable energy.

High ballast factor.

Frequency of only 2 to 3 Hz in ignitor start-up pulses, providing a better treatment to the lamp in case of reignition.

It has an integrated photocell.

It reduces the stroboscopic effect considerably.

These operating characteristics make this an electronic ballast that can be used widely as a substitute for the conventional ballasts that are currently in operation, to operate the different types and powers of high-pressure sodium-vapor lamps available for use in industrial, commercial, public and residential areas.

Having sufficiently described the technical and operating characteristics of our electronic ballast, we believe that it is a unique and novel invention, which represents an important technological advance, and therefore, we claim as our exclusive property the contents of the following claims:

1. A high-efficiency self-regulated electronic ballast with a single characteristic curve for operating high-pressure sodium-vapor lamps, comprising:

an alternating-current to direct-current converter circuit with overcurrent and overvoltage protective devices;

a voltage regulator circuit, which corrects the power factor and reduces harmonic distortion;

a direct-current to high-frequency alternating-current converter circuit;

a reducing autotransformer circuit with a current limiter inductor and ignitor, a photocontrolled switching circuit including an integrated photocell;

wherein said high-efficiency self-regulated electronic ballast is arranged to supply a regulated high-frequency alternating voltage to a limiter inductor-lamp unit (L2), which thereby causes the ballast to have a single ballast characteristic curve; and wherein said ballast is fixed to operate the lamp within a frequency range of 10 kHz to 20 kHz, in order to produce a maximum luminous flux emission.

2. The electronic ballast according to claim 1, wherein said electronic ballast establishes an average power consumption supplied to the lamp, throughout operation of the ballast within a regulation standardized trapezoid, based on said single ballast characteristic curve, when an average value of the area under said single ballast characteristic curve is defined; and, when ballast losses are added, an average power consumption from the ballast-lamp unit is also known.

3. The electronic ballast according to claim 1, wherein said electronic ballast is coupled in series with line terminal fuse (F) to provide overcurrent protection; said electronic ballast being coupled to a line filter (L1) connected as a common mode line filter and to a plurality of capacitors (C1, C19 and C20) to provide overvoltage protection; and, said electronic ballast also being coupled to a sidac (S1) in series with a resistor (R1) to provide active protection against overvoltages greater than a nominal voltage by 20%, whereby said protective device acts by opening said fuse (F), thus preventing the ballast from being damaged if there is an overvoltage exceeding the nominal voltage by more than 20%.

4. The electronic ballast according to claim 1, wherein the electronic ballast has a power factor of 0.999 and produces less than 10% harmonic distortion due to a regulator circuit that corrects the power factor and reduces harmonic distortion, said regulator circuit comprising:

an integrated circuit (C11), a plurality of resistors (R2 to R14), a potentiometer (RV1), a plurality of capacitors (C2 to C8), a transformer (T1), at least two diodes (D1, D2), and a MOSFET power transistor (MOS1);

wherein a direct-current regulated voltage from one point (G) with respect to another point (H), can be adjusted by said potentiometer (RV1);

said transformer (T1) being constructed with a ferrite core with an air gap and a coil assembly of a multifilament conductor, which makes it possible to reduce losses and the generation of heat in this transformer, thus increasing the efficiency of the ballast; and the number of turns of the transformer (T1) as well as its air gap and the selection of values and characteristics of the other components mentioned can be varied so that the ballast operates at different nominal voltages, and may include different direct-current voltages.

5. The electronic ballast according to claim 1, wherein said electronic ballast further comprises:

a limiter inductor-lamp unit (L2) which is supplied with a regulated alternating voltage frequency in a frequency range between 10 kHz and 20 kHz, which causes that the quantity of luminous flux emitted by the lamp is greater than that produced at 60 Hz with the same power supplied;

a direct-current to high-frequency alternating-current converter circuit which comprises:

an integrated circuit (C12), a plurality of resistors (R15 to R24, R33 and R34), a potentiometer (RV2), a plurality of capacitors (C9 to C15), a plurality of diodes (Z1 and D3 to D8), a transformer (T2), and MOSFET power transistors (MOS2 and MOS3);

wherein the oscillating frequency of said integrated circuit (C12) can be adjusted within said frequency range by said potentiometer (RV2) in conjunction with one of said capacitors (C11) and one of said resistors (R22); and said circuit receiving input supply for its operation, during the ballast operating start-up, from the secondary of a transformer (T1) through another of said resistors (R23) and one of said diodes (D7), and when the ballast is in stable continuous operation, it receives power from an auxiliary secondary of a transformer (T3) through another of said resistors (R24) and another of said diodes (D8), which in conjunction with another of said diodes (Z1) and others of said capacitors (C14 and C15) form the power source for this circuit;

whereby necessity is avoided for forming this source from the line or from point B, obtaining energy savings and reducing the number of components.

6. The electronic ballast according to claim 1, wherein high voltage pulses that ignite the lamp are applied at a lower frequency than that indicated in a standard, due to the inclusion of a diode (D9) which permits a capacitor (C16) to be charged slowly through a resistor (R25), independently of the operating frequency of the alternating voltage applied to the lamp, thus providing a better treatment to the lamp in case of reigniting, said pulses being produced by its reducing autotransformer circuit with a current limiter inductor and ignitor, which comprises an autotransformer (T3), a limiter inductor (L2), a resistor (R25), a capacitor (C16), a diode (D9) and a sidac (S2);

said components being interconnected in the following manner: first and third terminals (1 and 3) of said autotransformer (T3) correspond to a primary of such autotransformer and a secondary of such autotransformer is taken over a second terminal (2), with reference to said first terminal (1), corresponding to a point (I);

fourth and fifth terminals (4 and 5) of such autotransformer correspond to an auxiliary secondary and are connected to points (D and H), respectively;

said first terminal (1) of said limiter inductor (L2) is connected to said point (I) while said second and third terminals (2 and 3) of said limited inductor (L2) are connected to said capacitor (C16) and said sidac (S2), respectively;

the remaining terminals of said capacitor (C16) and said sidac (S2) are both joined to a resistor (R25) and this is connected to an anode of a diode (D9) having a cathode connected to a common point (H);

wherein said autotransformer (T3) receives at its input a high-frequency-regulated alternating voltage which is transformed when a ratio of said autotransformer (T3) is varied to obtain different voltages in its secondary, which correspond to a minimum open circuit voltage of the ballast and which are sufficient to operate each power and type of lamp;

said autotransformer (T3) being constructed with a ferrite core without an air gap and a coil assembly of a multifilament conductor, which makes it possible to reduce losses and the generation of heat in said autotransformer (T3), thus increasing the ballast's efficiency; said current limiter inductor (L2), besides having the function of limiting the current delivered to the lamp, acting as an autotransformer, which in conjunction with said capacitor (C16), said sidac (S2), said resistor (R25) and said diode (D9), generate high voltage pulses that turn on the lamp; said current limiter inductor (L2) being constructed with a ferrite core with an air gap and a coil assembly of a multifilament conductor, which makes it possible to reduce losses and the generation of heat in this inductor, thus increasing the ballast's efficiency;

wherein the number of turns of the current limiter inductor (L2) and its air gap can be varied in order to adjust its impedance to the adequate value for operating each power and type of lamp.

7. The electronic ballast according to claim 1, wherein the electronic ballast has the integrated functions of automatic igniting and/or extinguishing in accordance with preestablished levels of natural light due to its photocontrolled switching circuit, which is formed by a plurality of resistors (R26 to R32), at least two capacitors (C17 and C18), a zener diode (Z2), at least two npn transistors (Q1 and Q2), a photoresistor (RF) and a n-channel MOSFET power transistor (MOS4); said components being interconnected in the following manner:

resistor (R32) in series with parallel (Z2-C18) zener diode-capacitor forming the supply source whose positive and negative polarities are connected to the cathode and anode of zener diode (Z2), respectively;

resistor (R31) being connected to positive in series with said photoresistor (RF); from photoresistor (RF), resistor (R29) is connected in series with capacitor (C17) to a base of npn transistor (Q2);

resistor (R30) being connected from photoresistor (RF) to a collector of transistor (Q1); resistors (R26 and R27) being connected from positive to the collectors transistors (Q1 and Q2), respectively;

the emitters of both npn transistors being connected to negative polarity;

the gate of said power transistor (MOS4) being controlled from a (Q1) collector and being taken as extremes to electronically interrupt drain from the power transistor (MOS4) and its source; the latter is also connected to negative polarity; wherein the power transistor (MOS4) is a MOSFET power transistor, which electronically interrupts the input of the ballast operating in DC, thus preventing the losses caused by the use of a thyristor operating in AC.

* * * * *